US006523320B2

(12) United States Patent
Stoof

(10) Patent No.: US 6,523,320 B2
(45) **Date of Patent: *Feb. 25, 2003**

(54) HOISTING DEVICE FOR BIG LOADS

(75) Inventor: Pieter Maria Stoof, Breda (NL)

(73) Assignee: Mammoet Europe B.V., Amsterdam (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/424,893

(22) PCT Filed: May 29, 1998

(86) PCT No.: PCT/NL98/00313

§ 371 (c)(1),
(2), (4) Date: Feb. 3, 2000

(87) PCT Pub. No.: WO98/54080

PCT Pub. Date: Dec. 3, 1998

(65) Prior Publication Data

US 2002/0053550 A1 May 9, 2002

(30) Foreign Application Priority Data

May 30, 1997 (NL) ..... 1006187

(51) Int. Cl.[7] ..... E04H 12/10

(52) U.S. Cl. ..... 52/651.05; 52/651.07; 52/726.3; 52/731.4; 52/731.8; 52/732.3

(58) Field of Search ..... 212/177, 176, 212/347; 52/690, 692, 693, 731.2, 731.7, 732.1, 651.05, 651.06, 651.07, 651.01, 651.02, 651.03, 651.04, 651.08, 651.09, 651.1, 731.4, 731.8, 732.3

(56) References Cited

U.S. PATENT DOCUMENTS

| | | | | |
|---|---|---|---|---|
| 1,601,059 A | * | 9/1926 | Black | 52/651.06 |
| 1,730,995 A | * | 10/1929 | Cater | 52/651.05 |
| 3,323,660 A | | 6/1967 | Allin, Sr. | |
| 5,390,463 A | | 2/1995 | Sollner | |

FOREIGN PATENT DOCUMENTS

| | | | | |
|---|---|---|---|---|
| DE | 1254319 | * | 11/1967 | 212/347 |
| DE | 29718157 | | 4/1998 | |
| EP | 0530114 | | 3/1993 | |
| FR | 1436649 | | 2/1965 | |
| FR | 1476734 | | 2/1966 | |
| SU | 757674 | * | 8/1980 | 52/651.07 |
| SU | 1009975 | * | 4/1983 | 212/347 |
| SU | 1409573 | * | 7/1988 | 212/347 |

* cited by examiner

*Primary Examiner*—Michael Safavi
(74) *Attorney, Agent, or Firm*—Webb Ziesenheim Logsdon Orkin & Hanson, P.C.

(57) ABSTRACT

A hoisting device for big loads, comprising at least one hoisting mast, a foot arranged on the underside and hoisting means connected at least to the top. The hoisting device is assembled from mast parts which are mutually connectable by means of connecting means and the largest of which has dimensions which do not exceed those of a usual container. Each mast part is constructed as a framework structure consisting of angle bars and cross bars mutually connecting the angle bars. The angle bars consist of two parts with a set-square-shaped cross section of different dimensions and wherein the outer ends of the legs of the smaller lie against the legs of the larger and the larger part lies on the outer periphery of the mast part, so that mast parts are provided of the greatest possible strength and stiffness within the dimensions of typical containers.

7 Claims, 3 Drawing Sheets

HOISTING DEVICE FOR BIG LOADS

BACKGROUND OF THE INVENTION

The present invention relates to a hoisting device for big loads, comprising at least one hoisting mast, a foot arranged on the underside and hoisting means connected at least to the top, wherein the hoisting device is assembled from mast parts which are mutually connectable by means of connecting means and the largest of which has dimensions which do not exceed those of a usual container, and wherein each mast part is constructed as a framework structure consisting of angle bars and cross bars mutually connecting the angle bars.

The present invention relates particularly to hoisting devices which can handle, hoist and displace very large prefabricated modules such as chemical processing installations, offshore installations, windmills and so on, often of more than 1000 tons, to a great height in the order of magnitude of 120 m.

The projects on which these installations can be deployed are spread throughout the world. It will therefore be apparent that in choosing the dimensions of the components of the hoisting device account must be taken of transport to and from the location where the project is being carried out. The design of ships for transport by sea and inland waterways and developments in overland transport using trucks and trains are determined more and more by the use of sea-cargo containers. The locations for transhipment of goods are likewise being adapted increasingly for handling of these containers.

In order therefore to make the mobilization of lifting and hoisting material attractive in view of the described trends in the field of transport and to keep the associated costs acceptable, mast parts have been sought which embody the great strength and stiffness (bending and buckling) necessary for the hoisting device within the typical dimensions of sea-cargo containers and which can also be coupled in simple manner to form the desired mast length. Such a hoisting device is known from the international patent application no. PCT/NL97/00099.

The object of the present invention is to improve the hoisting device known from the prior art and to design mast parts of the greatest possible strength and stiffness within the dimensions of typical sea-cargo containers.

SUMMARY OF THE INVENTION

This object is achieved in that the angle bars consist of two parts with a set-square-shaped cross-section of different dimensions, wherein the outer ends of the legs of the smaller lie against the legs of the larger and the larger part lies on the outer periphery of the mast part.

The profile of the angle bars provides, relative to the usually applied profiles, an optimum use of the material within the dimensions defined by the standard container, also with a view to the other requirements relating to fixing of framework rods and the coupling method. The fixing surface between the angle bars and the cross bars is in fact flat, so that the cross bars can be arranged directly onto the angle bars without any modification. This design also provides the greatest possible available space inside the framework which enables optimal utilization of the mast part in the container application during transport.

The corners of the parts of the angle bars are preferably rounded. The parts of the angle bars are hereby easier to manufacture. In addition, no sharp edges are present on the mast parts.

For coupling of the mast parts the connecting means are slidably received in close-fitting manner in the angle bars, which means comprise two identical plate pieces and a filler body arranged therebetween. At least two holes are herein arranged in each plate piece and holes are arranged on the outer ends of the angle bars of each mast part, wherein the holes of the plate pieces lie in one line in each case with two holes of two mutually abutting mast parts for receiving a pin. The connecting means provide centering of the mast parts and absorption of the tensile and transverse forces (bending load) between the mast parts when the hoisting device is carried upward.

During moving upward of the hoisting device the maximum shearing force is to be found on the contact plane of the mast parts. In preference the filler body is therefore arranged between the holes of the plate pieces so that this filler body, which is situated on the contact plane of the mast parts, can absorb the maximum shearing force.

The centre distance between the holes of the plate pieces is such that the end surfaces of the mast parts abut one another. Once the crane has been raised, the mast parts lie mutually abutting and the forces occurring as a result of hoisting a load are for the most part transmitted directly from the one mast part to the other and the connecting means are almost not loaded.

In order to make the mast part suitable for transport, an auxiliary frame is arranged on each end surface of the mast part, which frame is provided with coupling means corresponding with those of the usual container, wherein the dimension between the coupling means on the one and on the other end surface of the mast part and the dimension between the coupling means on one side of the mast part mutually correspond with those of a usual container.

BRIEF DESCRIPTION OF THE DRAWING

The present invention will be further elucidated hereinbelow with reference to the annexed drawing. In the drawing.

DETAILED DESCRIPTION OF THE PREFERRED EMBODIMENT

Figure 1:
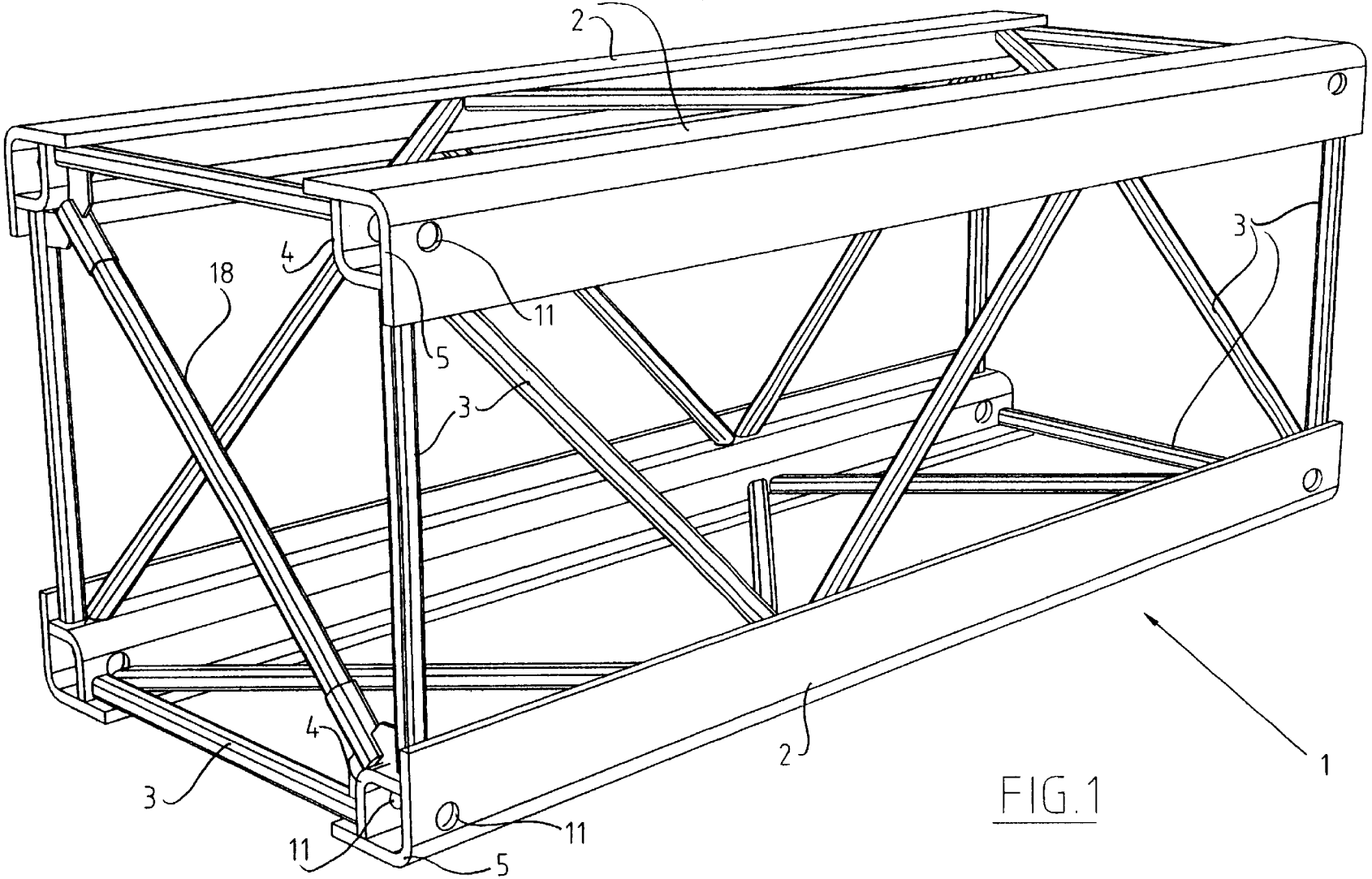
FIG. 1 shows a perspective view of the mast part according to the present invention.

Designated with numeral 1 is the mast part which is constructed as a framework structure and consists of angle bars 2 and cross bars 3 mutually connecting angle bars 2. Angle bars 2 consist of two parts 4, 5 of set-square-shaped cross-section with different dimensions. The outer ends of the legs of part 4 of smaller dimension herein lie against the legs of the part 5 of larger dimension. In addition, part 5 lies on the outer periphery of mast part 1 and the corners of parts 4, 5 of angle bars 2 are rounded. FIG. 1 shows clearly that the fixing surfaces between cross bars 3 and angle bars 2 are flat. In addition, FIG. 1 shows with one diagonal 18 in the left-hand end surface plane of mast part 1 that the design of the profile of the angle bars provides the greatest possible usable space inside the framework structure for transport purposes.

Figure 2:
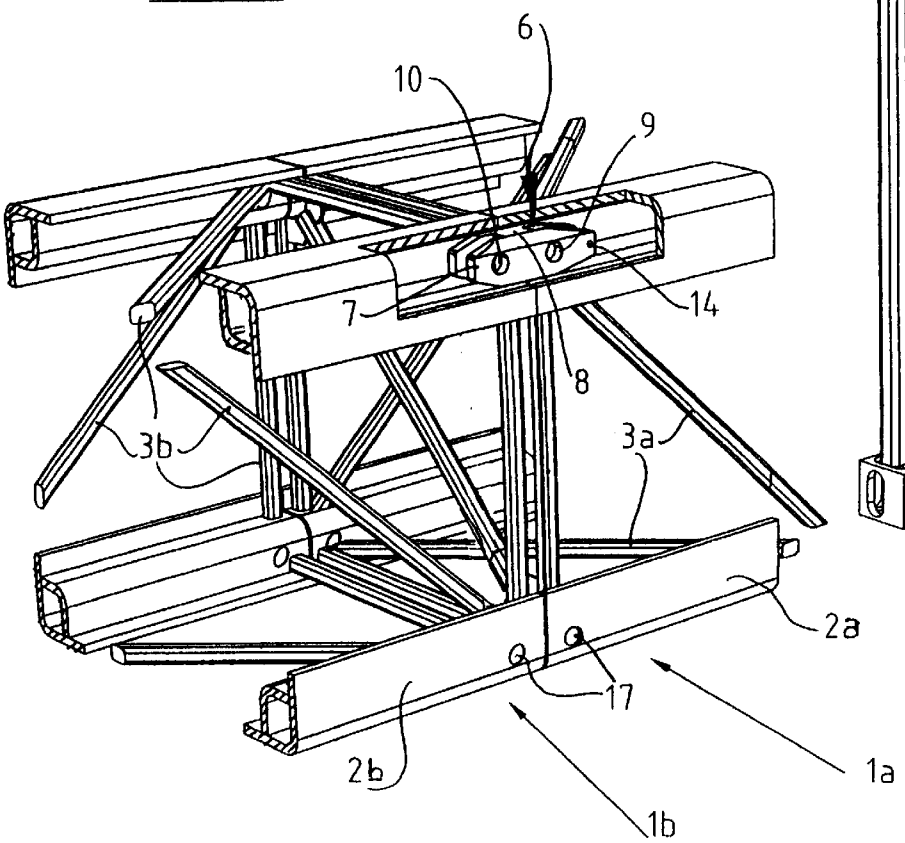
FIG. 2 shows a perspective detail view of two mutually abutting mast parts, wherein the coupling of the mast parts by means of the connecting means according-to the present invention is shown.
Figure 3:
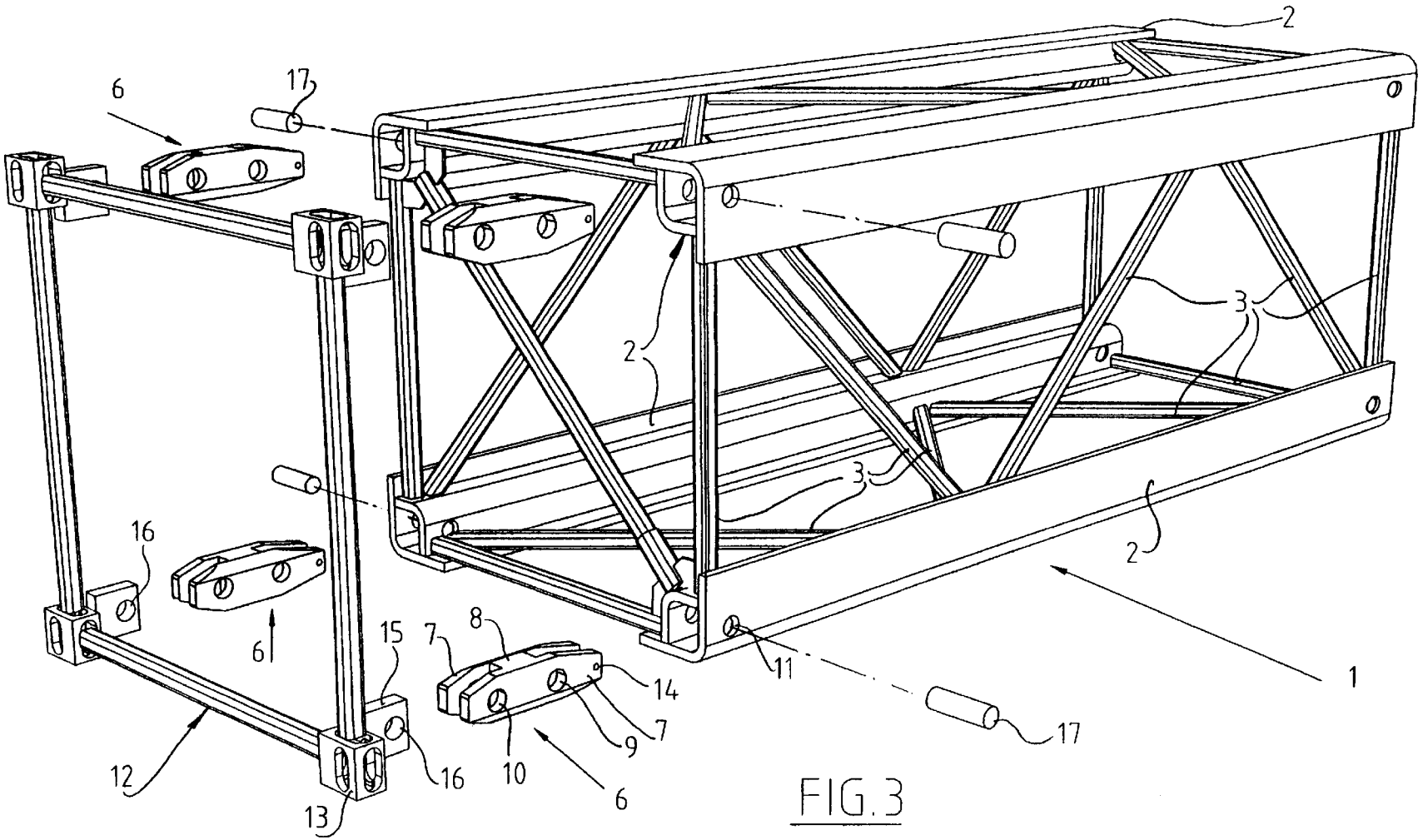
FIG. 3 is a perspective view with disassembled parts of the mast part and the auxiliary frame according to the present invention.

In FIG. 2 two mutually abutting mast parts 1*a*, 1*b* are mutually coupled by means of connecting means 6. Connecting means 6 can be seen at the top of FIG. 2 because angle bars 2*a*, 2*b* are partly broken away. Connecting means 6 are slidably received in close-fitting manner in angle bars 2*a*, 2*b* of mast parts 1*a*, 1*b*. Each mast part 1*a*, 1*b* has on one end surface thereof four connecting means 6. These latter comprise two identical plate pieces 7 and a filler body 8 arranged therebetween. Filler body 8 can, as shown in the figures, be formed integrally with plate pieces 7 but may also be a separate part. In FIG. 2 the two plate pieces 7 lie mutually aligned. Two holes 9, 10 are arranged in each plate piece 7. Holes 11, which can be seen in FIGS. 1 and 3, are likewise arranged on the outer ends of angle bars 2*a*, 2*b* of each mast part 1*a*, 1*b*. Plate pieces 7 can slide into angle bars 2*a*, 2*b* such that holes 9, 10 of plate pieces 7 lie in one line with each of the holes 11 of two mutually abutting mast parts 1*a*, 1*b*. Pins 17 are inserted through holes 9, 10, 11 to couple mast parts 1*a*, 1*b*. In this position another pin (not shown) can moreover be placed in hole 14 to prevent small displacements of connecting means 6 in angle bar 2*a*.

FIG. 3 shows with disassembled parts the mast part 1 with an auxiliary frame 12. In assembly, as shown partly in FIG. 4, an auxiliary frame 12 is arranged on both end surfaces of mast part 1. Auxiliary frames 12 are provided on each corner point with coupling means 13 which correspond with those of a typical container, the so-called twist-lock connection. The dimension between the coupling means 13 on the one and on the other end surface of mast part 1 and the dimension between the coupling means 13 on one side of mast part 1 mutually correspond with those of a typical container. Ears 15 with holes 16 are mounted on auxiliary frames 12 for coupling of auxiliary frame 12 to the mast part 1 for transport purposes.

Figure 4:
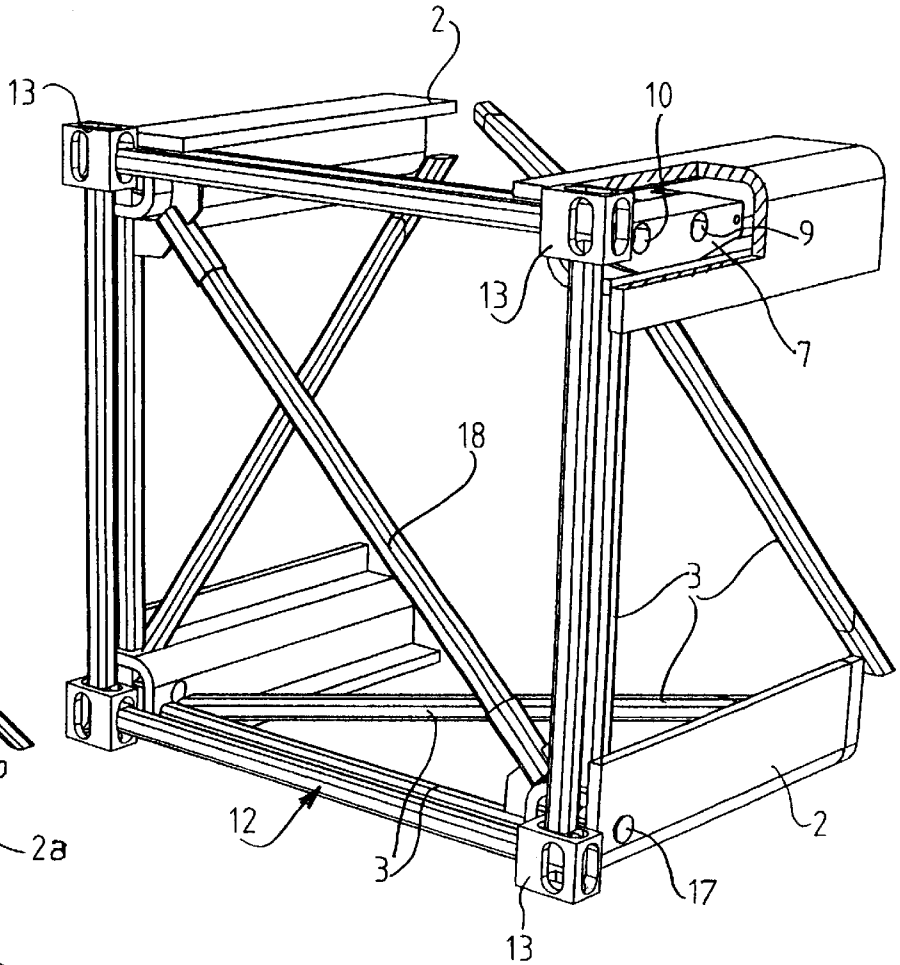
FIG. 4 is a partly perspective view as according to FIG. 3 in assembly.

FIG. 4 shows partly in perspective the assembly of mast part 1 and auxiliary frame 12. For coupling of each auxiliary frame 12 to mast part 1 the connecting means 6 are pushed into the angle bars 2, as can be seen in the broken away part of FIG. 4. Ears 15 of auxiliary frame 12 are then placed between plate parts 7 of connecting means 6, wherein the holes 11 arranged in angle bars 2, the holes 10 arranged in plate pieces 7 and the holes 16 arranged in ears 15 lie in one line. The above described pins 17 are placed through the holes 11, 10 and 16 lying in one line. In this manner two auxiliary frames 12 at a time are fixed to each mast part 1, whereby the whole unit can be handled and transported as a typical container.

Angle bars 2 are preferably manufactured from a high-grade fine-grained steel type with a yield point of more than 690 N/mm$^2$. Connecting means 6 are likewise embodied in a high-grade steel quality. The present design of the mast parts 1 results in an 80% greater strength and a 30% greater stiffness compared to the mast parts known from the prior art.

For auxiliary masts, which in particular cases may have a smaller cross-sectional dimension, the mast parts are designed on the basis of the same principles as described here. The optimal external dimensions of these auxiliary mast parts—possible because of the enlarged space inside the main mast parts—are chosen such that for transport purposes these parts can slide into the above described main mast parts.

Finally, the container obtained in this manner can be filled to the maximum permitted weight with other components which are important for the embodiment, such as foot plates for the mast, hoisting means, counter-weight and so on.

What is claimed is:

1. A hoisting device having one or more mast parts, each mast part comprising:

a plurality of elongated angle bars, each angle bar having a first part including a pair of legs extending at right angles to each other from a corner of the first part and a second part including a pair of legs extending at right angles to each other from a corner of the second part, the first part and the second part being secured together so that an end of one leg of the first part opposite the corner thereof abuts a side of one leg of the second part between the corner of the second part and an end of the one leg of the second part opposite the corner thereof, and an end of the other leg of the first part opposite the corner thereof abuts a side of the other leg of the second part between the corner of the second part and an end of the other leg of the second part opposite the corner thereof, the legs and corners of the first part and the second part of each angle bar defining a conduit that extends between opposite ends thereof;

a plurality of elongated cross bars securing the angle bars in spaced parallel relation, each cross bar having opposite ends, with one end of each cross bar connected to one angle bar and with the other end of each cross bar connected to another angle bar;

at least one connector having a pair of opposed plate pieces secured by a filler body in spaced parallel relation defining at least one gap therebetween, each plate piece having therein at least one hole which is aligned coaxially with the hole in the other plate piece across the gap, wherein at least one conduit of the mast part adjacent one end thereof slidably receives the one connector with the holes of the plate pieces thereof positioned coaxial with a hole formed in the angle bar defining the one conduit; and an auxiliary frame having at least one coupler including an ear configured to be received in the one conduit of the mast part adjacent the one end thereof and in the gap between the plate pieces of the one connector received in the one conduit, the ear having therein a hole which is aligned coaxially with the holes in the plate pieces of the one connector and the hole formed in the angle bar defining the one conduit for receiving a pin.

2. The hoisting device as claimed in claim 1, further including another auxiliary frame having at least one coupler including an ear configured to be received in the one conduit of the mast part at the other end thereof and in a gap between plate pieces of another connector received in the one conduit adjacent the other end of the mast part, the ear of the other coupler having therein a hole which is aligned coaxially with the holes in the plate pieces of the other connector and another hole formed in the angle bar defining the other conduit for receiving another pin.

3. A hoisting device having one or more mast parts, each mast part comprising:

a plurality of elongated angle bars, each angle bar having a first part including a pair of legs extending at right angles to each other from a corner of the first part and a second part including a pair of legs extending at right angles to each other from a corner of the second part, the first part and the second part being secured together so that an end of one leg of the first part opposite the corner thereof abuts a side of one leg of the second part between the corner of the second part and an end of the one leg of the second part opposite the corner thereof, and an end of the other leg of the first part opposite the corner thereof abuts a side of the other leg of the second part between the corner of the second part and an end of the other leg of the second part opposite the corner thereof, and a plurality of elongated cross bars securing the angle bars in spaced parallel relation, each cross bar having opposite ends, with one end of each cross bar connected to one angle bar and with the other end of each cross bar connected to another angle bar, wherein:

the one end of each cross bar is connected to the one angle bar on the side of one of the legs of the second part where one of the legs of the first part abuts said side of one of the legs of the second part; and the other end of each cross bar is connected to the other angle bar on the side of the one of the legs of the second part where one of the legs of the first part abuts said side of the one of the legs of the second part.

4. The hoisting device as claimed in claim 3, wherein the ends of the cross bars are connected to the angle bars only adjacent a periphery of the mast part.

5. A hoisting device having one or more mast parts, each mast part comprising:

a plurality of elongated angle bars, each angle bar having a first part including a pair of legs extending at right angles to each other from a corner of the first part and a second part including a pair of legs extending at right angles to each other from a corner of the second part, the first part and the second part being secured together so that an end of one leg of the first part opposite the corner thereof abuts a side of one leg of the second part between the corner of the second part and an end of the one leg of the second part opposite the corner thereof, and an end of the other leg of the first part opposite the corner thereof abuts a side of the other leg of the second part between the corner of the second part and an end of the other leg of the second part opposite the corner thereof, the legs and corners of the first part and the second part of each angle bar defining a conduit that extends between opposite ends thereof;

a plurality of elongated cross bars securing the angle bars in spaced parallel relation, each cross bar having opposite ends, with one end of each cross bar connected to one angle bar and with the other end of each cross bar connected to another angle bar; and a plurality of connectors, each connector having a pair of opposed plate pieces secured in spaced parallel relation by a filler body, each plate piece having at least two holes therein, wherein each connector is configured to be slidably received in a pair of aligned conduits of two mast parts abutted together with at least one hole of each plate piece positioned coaxial with a hole formed in the angle bar defining the conduit of one mast part for receiving a pin and at least one other hole of each plate piece positioned coaxial with a hole formed in an angle bar defining the conduit of the other mast part for receiving another pin.

6. The hoisting device as claimed in claim 5, wherein the filler body is disposed between the holes of the plate pieces.

7. A hoisting device having one or more mast parts, each mast part comprising:

a plurality of elongated angle bars, each angle bar having a first part including a pair of legs extending at right angles to each other from a corner of the first part and a second part including a pair of legs extending at right angles to each other from a corner of the second part, the first part and the second part being secured together so that an end of one leg of the first part opposite the corner thereof abuts a side of one leg of the second part between the corner of the second part and an end of the one leg of the second part opposite the corner thereof, and an end of the other leg of the first part opposite the corner thereof abuts a side of the other leg of the second part between the corner of the second part and an end of the other leg of the second part opposite the corner thereof, wherein the corners of the first and second parts are rounded; and a plurality of elongated cross bars securing the angle bars in spaced parallel relation, each cross bar having opposite ends, with one end of each cross bar connected to one angle bar and with the other end of each cross bar connected to another angle bar.

* * * * *